US007857413B2

(12) United States Patent
Shamoun

(10) Patent No.: US 7,857,413 B2
(45) Date of Patent: Dec. 28, 2010

(54) SYSTEMS AND METHODS FOR CONTROLLING AND TESTING JETTING STABILITY IN INKJET PRINT HEADS

(75) Inventor: Bassam Shamoun, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 474 days.

(21) Appl. No.: 12/041,658

(22) Filed: Mar. 3, 2008

(65) Prior Publication Data

US 2008/0211847 A1 Sep. 4, 2008

Related U.S. Application Data

(60) Provisional application No. 60/892,429, filed on Mar. 1, 2007, provisional application No. 60/892,457, filed on Mar. 1, 2007.

(51) Int. Cl.
*B41J 29/393* (2006.01)

(52) U.S. Cl. ..... 347/19

(58) Field of Classification Search ..... 347/9–11, 347/19, 58; 327/82, 83, 86, 87, 170; 326/82, 326/83, 86, 87
See application file for complete search history.

(56) References Cited

U.S. PATENT DOCUMENTS

| | | | |
|---|---|---|---|
| 4,571,601 | A | 2/1986 | Teshina |
| 4,987,043 | A | 1/1991 | Roosen et al. |
| 5,114,760 | A | 5/1992 | Takemura et al. |
| 5,177,627 | A | 1/1993 | Ishiwata et al. |
| 5,232,634 | A | 8/1993 | Sawada et al. |
| 5,232,781 | A | 8/1993 | Takemura et al. |
| 5,264,952 | A | 11/1993 | Fukutani et al. |
| 5,340,619 | A | 8/1994 | Chen et al. |
| 5,399,450 | A | 3/1995 | Matsushima et al. |
| 5,432,538 | A | 7/1995 | Carlotta |

(Continued)

FOREIGN PATENT DOCUMENTS

| | | |
|---|---|---|
| DE | 1 218 473 | 6/1966 |

(Continued)

OTHER PUBLICATIONS

Notice of Allowance of U.S. Appl. No. 11/846,770 (11261) mailed Aug. 28, 2009.

*Primary Examiner*—Lamson D Nguyen
(74) *Attorney, Agent, or Firm*—Dugan & Dugan, PC

(57) ABSTRACT

The present invention provides systems, methods, and apparatus for monitoring and controlling a slew rate of a voltage signal provided to a PZT capacitor of a print head. The system includes a digital driver circuit adapted to generate a signal indicating a nominal slew rate, a probe circuit for measuring a firing pulse voltage signal provided to the capacitor, a comparator coupled to the digital driver and the probe circuit comparing a measured slew rate with the nominal slew rate generating a signal indicating a difference between the measured slew rate and the nominal slew rate, an analog driver circuit coupled to the comparator adapted to adjust the slew rate of the voltage signal in response to the difference signal, and an analog/digital converter adapted to sample the voltage signal output from the probe circuit and to provide an output for diagnostic purposes. Numerous other features and aspects are disclosed.

21 Claims, 6 Drawing Sheets

U.S. PATENT DOCUMENTS

| | | | |
|---|---|---|---|
| 5,552,192 | A | 9/1996 | Kashiwazaki et al. |
| 5,554,466 | A | 9/1996 | Matsushima et al. |
| 5,593,757 | A | 1/1997 | Kashiwazaki et al. |
| 5,626,994 | A | 5/1997 | Takayanagi et al. |
| 5,648,198 | A | 7/1997 | Shibata |
| 5,702,776 | A | 12/1997 | Hayase et al. |
| 5,705,302 | A | 1/1998 | Ohno et al. |
| 5,714,195 | A | 2/1998 | Shiba et al. |
| 5,716,739 | A | 2/1998 | Kashiwazaki et al. |
| 5,716,740 | A | 2/1998 | Shiba et al. |
| 5,726,724 | A | 3/1998 | Shirota et al. |
| 5,748,266 | A | 5/1998 | Kodate |
| 5,757,387 | A | 5/1998 | Manduley |
| 5,811,209 | A | 9/1998 | Eida et al. |
| 5,817,441 | A | 10/1998 | Iwata et al. |
| 5,831,704 | A | 11/1998 | Yamada et al. |
| 5,847,735 | A | 12/1998 | Betschon |
| 5,880,799 | A | 3/1999 | Inoue et al. |
| 5,895,692 | A | 4/1999 | Shirasaki et al. |
| 5,916,713 | A | 6/1999 | Ochiai et al. |
| 5,916,735 | A | 6/1999 | Nakashima et al. |
| 5,922,401 | A | 7/1999 | Kashiwazaki et al. |
| 5,948,576 | A | 9/1999 | Shirota et al. |
| 5,948,577 | A | 9/1999 | Nakazawa et al. |
| 5,956,063 | A | 9/1999 | Yokoi et al. |
| 5,962,581 | A | 10/1999 | Hayase et al. |
| 5,968,688 | A | 10/1999 | Masuda et al. |
| 5,969,780 | A | 10/1999 | Matsumoto et al. |
| 5,984,470 | A | 11/1999 | Sakino et al. |
| 5,989,757 | A | 11/1999 | Satoi |
| 6,013,415 | A | 1/2000 | Sakurai et al. |
| 6,025,898 | A | 2/2000 | Kashiwazaki et al. |
| 6,025,899 | A | 2/2000 | Fukunaga et al. |
| 6,042,974 | A | 3/2000 | Iwata et al. |
| 6,063,527 | A | 5/2000 | Nishikawa et al. |
| 6,066,357 | A | 5/2000 | Tang et al. |
| 6,071,989 | A | 6/2000 | Sieber et al. |
| 6,078,377 | A | 6/2000 | Tomono et al. |
| 6,087,196 | A | 7/2000 | Sturm et al. |
| 6,134,059 | A | 10/2000 | Shirota et al. |
| 6,140,988 | A | 10/2000 | Yamada |
| 6,142,604 | A | 11/2000 | Kanda et al. |
| 6,145,981 | A | 11/2000 | Akahira et al. |
| 6,149,257 | A | 11/2000 | Yanaka et al. |
| 6,153,711 | A | 11/2000 | Towns et al. |
| 6,154,227 | A | 11/2000 | Lund |
| 6,158,858 | A | 12/2000 | Fujiike et al. |
| 6,162,569 | A | 12/2000 | Nakashima et al. |
| 6,196,663 | B1 | 3/2001 | Wetchler et al. |
| 6,211,347 | B1 | 4/2001 | Sieber et al. |
| 6,224,205 | B1 | 5/2001 | Akahira et al. |
| 6,226,067 | B1 | 5/2001 | Nishiguchi et al. |
| 6,228,435 | B1 | 5/2001 | Yoshikawa et al. |
| 6,234,626 | B1 | 5/2001 | Axtell et al. |
| 6,242,139 | B1 | 6/2001 | Hedrick et al. |
| 6,244,702 | B1 | 6/2001 | Sakino et al. |
| 6,264,322 | B1 | 7/2001 | Axtell et al. |
| 6,270,930 | B1 | 8/2001 | Okabe |
| 6,271,902 | B1 | 8/2001 | Ogura et al. |
| 6,277,529 | B1 | 8/2001 | Marumoto et al. |
| 6,281,560 | B1 | 8/2001 | Allen et al. |
| 6,281,960 | B1 | 8/2001 | Kishimoto et al. |
| 6,312,771 | B1 | 11/2001 | Kashiwazaki et al. |
| 6,322,936 | B1 | 11/2001 | Nishikawa et al. |
| 6,323,921 | B1 | 11/2001 | Kurauchi et al. |
| 6,331,384 | B1 | 12/2001 | Satoi |
| 6,341,840 | B1 | 1/2002 | van Doorn et al. |
| 6,344,301 | B1 | 2/2002 | Akutsu et al. |
| 6,356,357 | B1 | 3/2002 | Anderson et al. |
| 6,358,602 | B1 | 3/2002 | Horiuchi et al. |
| 6,367,908 | B1 | 4/2002 | Serra et al. |
| 6,384,528 | B1 | 5/2002 | Friend et al. |
| 6,384,529 | B2 | 5/2002 | Tang et al. |
| 6,386,675 | B2 | 5/2002 | Wilson et al. |
| 6,388,675 | B1 | 5/2002 | Kamada et al. |
| 6,392,728 | B2 | 5/2002 | Tanaka et al. |
| 6,392,729 | B1 | 5/2002 | Izumi et al. |
| 6,399,257 | B1 | 6/2002 | Shirota et al. |
| 6,417,908 | B2 | 7/2002 | Nishiguchi et al. |
| 6,424,393 | B1 | 7/2002 | Hirata et al. |
| 6,424,397 | B1 | 7/2002 | Kuo |
| 6,426,166 | B2 | 7/2002 | Nishikawa et al. |
| 6,428,135 | B1 | 8/2002 | Lubinsky et al. |
| 6,428,151 | B1 | 8/2002 | Yi et al. |
| 6,429,601 | B1 | 8/2002 | Friend et al. |
| 6,429,916 | B1 | 8/2002 | Nakata et al. |
| 6,433,852 | B1 | 8/2002 | Sonoda et al. |
| 6,450,635 | B1 | 9/2002 | Okabe et al. |
| 6,455,208 | B1 | 9/2002 | Yamashiki et al. |
| 6,462,798 | B1 | 10/2002 | Kim et al. |
| 6,464,329 | B1 | 10/2002 | Koitabashi et al. |
| 6,464,331 | B1 | 10/2002 | Van Doorn et al. |
| 6,468,702 | B1 | 10/2002 | Yi et al. |
| 6,475,271 | B2 | 11/2002 | Lin |
| 6,476,888 | B2 | 11/2002 | Yamanashi |
| 6,480,253 | B1 | 11/2002 | Shigeta et al. |
| 6,498,049 | B1 | 12/2002 | Friend et al. |
| 6,508,533 | B2 | 1/2003 | Tsujimoto et al. |
| 6,518,700 | B1 | 2/2003 | Friend et al. |
| 6,557,984 | B2 | 5/2003 | Tanaka et al. |
| 6,569,706 | B2 | 5/2003 | Pakbaz et al. |
| 6,580,212 | B2 | 6/2003 | Friend |
| 6,627,364 | B2 | 9/2003 | Kiguchi et al. |
| 6,630,274 | B1 | 10/2003 | Kiguchi et al. |
| 6,667,795 | B2 | 12/2003 | Shigemura |
| 6,686,104 | B1 | 2/2004 | Shiba et al. |
| 6,692,983 | B1 | 2/2004 | Chen et al. |
| 6,693,611 | B1 | 2/2004 | Burroughes |
| 6,695,905 | B2 | 2/2004 | Rozumek et al. |
| 6,698,866 | B2 | 3/2004 | Ward et al. |
| 6,705,694 | B1 | 3/2004 | Barbour et al. |
| 6,738,113 | B2 | 5/2004 | Yu et al. |
| 6,762,234 | B2 | 7/2004 | Grizzi |
| 7,271,824 | B2 | 9/2007 | Omori et al. |
| 7,413,272 | B2 | 8/2008 | Shamoun et al. |
| 7,656,209 | B2 * | 2/2010 | Mei ..... 327/170 |
| 7,683,672 | B2 * | 3/2010 | Bartlett ..... 326/83 |
| 2001/0012596 | A1 | 8/2001 | Kunimoto et al. |
| 2002/0054197 | A1 | 5/2002 | Okada et al. |
| 2002/0081376 | A1 | 6/2002 | Yonehara |
| 2002/0128515 | A1 | 9/2002 | Ishida et al. |
| 2003/0025446 | A1 | 2/2003 | Lin et al. |
| 2003/0030715 | A1 | 2/2003 | Cheng et al. |
| 2003/0039803 | A1 | 2/2003 | Burroughes |
| 2003/0076454 | A1 | 4/2003 | Burroughes |
| 2003/0117455 | A1 | 6/2003 | Bruch et al. |
| 2003/0118921 | A1 | 6/2003 | Chen et al. |
| 2003/0171059 | A1 | 9/2003 | Kawase et al. |
| 2003/0189604 | A1 | 10/2003 | Bae et al. |
| 2003/0218645 | A1 | 11/2003 | Dings et al. |
| 2003/0222927 | A1 | 12/2003 | Koyama |
| 2003/0224621 | A1 | 12/2003 | Ostergard et al. |
| 2004/0008243 | A1 | 1/2004 | Sekiya |
| 2004/0018305 | A1 | 1/2004 | Pagano et al. |
| 2004/0023467 | A1 | 2/2004 | Karpov et al. |
| 2004/0023567 | A1 | 2/2004 | Koyama et al. |
| 2004/0041155 | A1 | 3/2004 | Grzzi et al. |
| 2004/0075383 | A1 | 4/2004 | Endo et al. |
| 2004/0075789 | A1 | 4/2004 | Wang |
| 2004/0086631 | A1 | 5/2004 | Han et al. |
| 2004/0094768 | A1 | 5/2004 | Yu et al. |
| 2004/0097101 | A1 | 5/2004 | Kwong et al. |
| 2004/0097699 | A1 | 5/2004 | Holmes et al. |
| 2004/0109051 | A1 | 6/2004 | Bright et al. |

| | | | |
|---|---|---|---|
| 2004/0125181 | A1 | 7/2004 | Nakamura |
| 2004/0218002 | A1 | 11/2004 | Nakamura |
| 2005/0041073 | A1 | 2/2005 | Fontaine et al. |
| 2005/0057599 | A1 | 3/2005 | Takenaka et al. |
| 2005/0083364 | A1 | 4/2005 | Billow |
| 2006/0092436 | A1 | 5/2006 | White et al. |
| 2006/0109290 | A1 | 5/2006 | Shamoun et al. |
| 2006/0109296 | A1 | 5/2006 | Shamoun et al. |
| 2007/0042113 | A1 | 2/2007 | Ji et al. |
| 2008/0211847 | A1 | 9/2008 | Shamoun |
| 2009/0058918 | A1 | 3/2009 | Shamoun |

FOREIGN PATENT DOCUMENTS

| | | |
|---|---|---|
| EP | 0 675 385 | 10/1995 |
| EP | 1 106 360 | 6/2001 |
| EP | 1 557 270 | 7/2005 |
| JP | 59-075205 | 4/1984 |
| JP | 61-245106 | 10/1986 |
| JP | 63-235901 | 9/1988 |
| JP | 63-294503 | 12/1988 |
| JP | 01-277802 | 11/1989 |
| JP | 02-173703 | 7/1990 |
| JP | 02-173704 | 7/1990 |
| JP | 07-198924 | 8/1995 |
| JP | 08-160219 | 6/1996 |
| JP | 10-039130 | 2/1998 |
| JP | 10-073813 | 3/1998 |
| JP | 2002-277622 | 9/2002 |
| JP | 2003-303544 | 10/2003 |
| JP | 2004-077681 | 3/2004 |
| WO | WO 02/14076 | 2/2002 |
| WO | WO 03/045697 | 6/2003 |

* cited by examiner

SYSTEMS AND METHODS FOR CONTROLLING AND TESTING JETTING STABILITY IN INKJET PRINT HEADS

The present application claims priority to U.S. Provisional Patent Application Ser. No. 60/892,429, filed Mar. 1, 2007, entitled "SYSTEMS AND METHODS FOR CONTROLLING JETTING STABILITY IN INKJET PRINT HEADS" and to U.S. Provisional Patent Application Ser. No. 60/892,457, filed Mar. 1, 2007, entitled "SYSTEMS AND METHODS FOR IN-SITU DIAGNOSTICS FOR AN INKJET PRINT HEAD DRIVER", both of which are hereby incorporated herein by reference in their entirety for all purposes.

RELATED APPLICATIONS

The present invention is also related to U.S. patent application Ser. No. 11/238,632, filed on Sep. 29, 2005 and entitled "METHODS AND APPARATUS FOR INKJET PRINTING COLOR FILTERS FOR DISPLAYS".

Further, the present invention is related to U.S. patent application Ser. No. 11/238,637, filed Sep. 29, 2005 and entitled "METHODS AND APPARATUS FOR A HIGH RESOLUTION INKJET FIRE PULSE GENERATOR".

Further, the present application is related to U.S. patent application Ser. No. 11/466,507, filed Aug. 23, 2006 and entitled "METHODS AND APPARATUS FOR INKJET PRINTING COLOR FILTERS FOR DISPLAYS USING PATTERN DATA".

Further, the present application is related to U.S. patent application Ser. No. 11/061,120, filed Feb. 18, 2005 and entitled "METHODS AND APPARATUS FOR PRECISION CONTROL OF PRINT HEAD ASSEMBLIES".

Further, the present application is related to U.S. patent application Ser. No. 11/061,148, filed on Feb. 18, 2005 and entitled "METHODS AND APPARATUS FOR INKJET PRINTING OF COLOR FILTERS FOR DISPLAYS".

All of the above-identified applications are hereby incorporated by reference herein in their entirety for all purposes.

FIELD OF THE INVENTION

The present invention relates to systems and methods for inkjet printing color filters for flat panel displays, and more particularly, the present invention relates to improving ink jetting accuracy.

BACKGROUND OF THE INVENTION

Printing color filters for flat panel displays using inkjet print heads may be difficult to do efficiently and cost effectively if precise control over the ink jetting cannot be maintained. Numerous factors may effect the location, size, and shape of an ink drop deposited on a substrate by an inkjet print head. Making adjustments for these numerous factors may be difficult. Thus, what is needed are systems, methods and apparatus to help manage ink jetting characteristics to improve control of ink jetting.

SUMMARY OF THE INVENTION

In various embodiments, the present invention provides systems, methods, and apparatus for monitoring and controlling a slew rate of a voltage signal provided to a PZT capacitor of a print head. An exemplary system includes a digital driver circuit adapted to generate and transmit a signal indicating a nominal slew rate; a probe circuit coupled to the capacitor for measuring an actual slew rate of the voltage signal provided to the capacitor; a comparator coupled to the digital driver and the probe circuit adapted to compare the measured slew rate with the nominal slew rate and to generate a difference signal indicating a difference in magnitude between the measured slew rate and the nominal slew rate; and an analog driver circuit coupled to the comparator adapted to adjust the slew rate of the voltage signal provided to the capacitor in response to the difference signal received from the comparator.

In various other embodiments, the present invention provides systems, methods, and apparatus for monitoring characteristics of a voltage signal provided to a PZT capacitor of a print head. An exemplary system includes a digital driver circuit adapted to generate and transmit a signal indicating a nominal slew rate; a probe circuit coupled to the capacitor for measuring a firing pulse voltage signal provided to the capacitor; a comparator coupled to the digital driver and the probe circuit adapted to compare a measured slew rate as determined from the measured firing pulse voltage signal with the nominal slew rate and to generate a difference signal indicating a difference in magnitude between the measured slew rate and the nominal slew rate; an analog driver circuit coupled to the comparator adapted to adjust the slew rate of the voltage signal provided to the capacitor in response to the difference signal received from the comparator; and an analog/digital converter coupled to the probe circuit adapted to sample the firing pulse voltage signal output from the probe circuit and to provide a digital output signal for diagnostic purposes. Other features and aspects of the present invention will become more fully apparent from the following detailed description, the appended claims and the accompanying drawings.

DETAILED DESCRIPTION OF THE INVENTION

In some inkjet printer systems, piezoelectric transducers (PZTs) are used to discharge (or 'jet') drops of ink through nozzles of a print head. When an electric potential is applied to a PZT, the PZT behaves like a capacitor in that positive and negative charges within the crystal layers embedded within the PZT are segregated and a corresponding electric field builds across the PZT.

Figure 1:
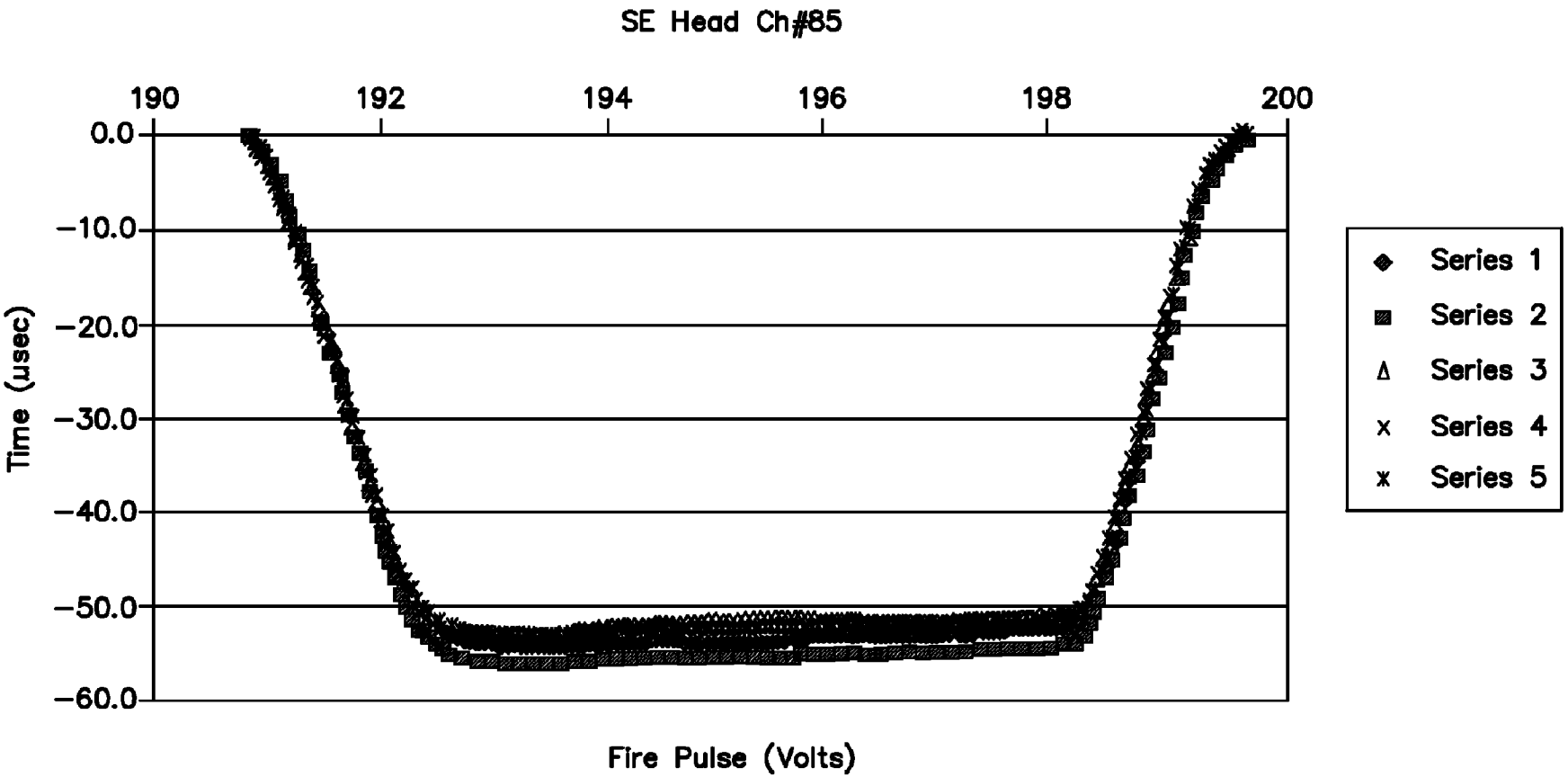
FIG. 1 is an example graph of fire pulse voltage versus time across an exemplary PZT channel taken in five consecutive jetting series.

When the capacitance of a PZT experiences variation due to any source of instability, variation in jetting characteristics, such as ink drop volume, often results, which may negatively affect printing performance. FIG. 1 is an example graph of five consecutively-taken series of fire pulse voltage data versus time across an exemplary PZT channel, which illustrates such variation in PZT capacitance. As shown, one of the series, denoted series #2, shows a marked decrease in voltage in comparison to the other series. More specifically, the rate of change of firing voltage over time (dV/dt), termed the 'slew rate', is higher (in an absolute sense) in series #2 than in the other series. Since the slew rate across a capacitor is equal to the current divided by the capacitance:

$$dV/dt=I/C \quad (1),$$

the higher slew rate exhibited by series #2 reflects a decrease in PZT capacitance given a stable current.

The incremental change in fire pulse voltage (dV) resulting from the PZT capacitance variation (dC) can be calculated from the expression for the total energy needed to charge a capacitor to a voltage V:

$$E=\tfrac{1}{2}CV^2 \quad (2).$$

Thus, if the capacitance of a PZT changes from $C_0$ to $C_1$, then to conserve energy, it is required that:

$$C_1(V+dV)^2=C_0V^2 \quad (3), \text{ and}$$

$$dV=V(1-\sqrt{(C_0/C_1)}) \quad (4),$$

indicating the magnitude of the voltage change due to the change in capacitance from $C_0$ to $C_1$.

Unfortunately however, there is currently no way to determine the capacitance change of a PZT prior to a particular jetting event, which makes compensation for this change a challenging task.

The present invention provides a system and method for compensating for changes in PZT capacitance by controlling the slew rate. In some embodiments, the slew rate is determined by taking firing pulse voltage measurements at time intervals, and the slew rate is then adjusted based on the measured slew rate via a feedback loop to approximate a nominal set slew rate value. Thus, a change in dV/dt due to a change in capacitance may be compensated by a countervailing change in charging current. In particular embodiments, an analog driver is coupled to each PZT to monitor the slew rate and compensate for any change in capacitance during ramp up and ramp down phases. The analog driver may include a diagnostic probe adapted to measure the firing pulse voltage at specific points in time along the firing pulse waveform and output the measurements for further processing (e.g., diagnostic or testing processes).

Figure 2:
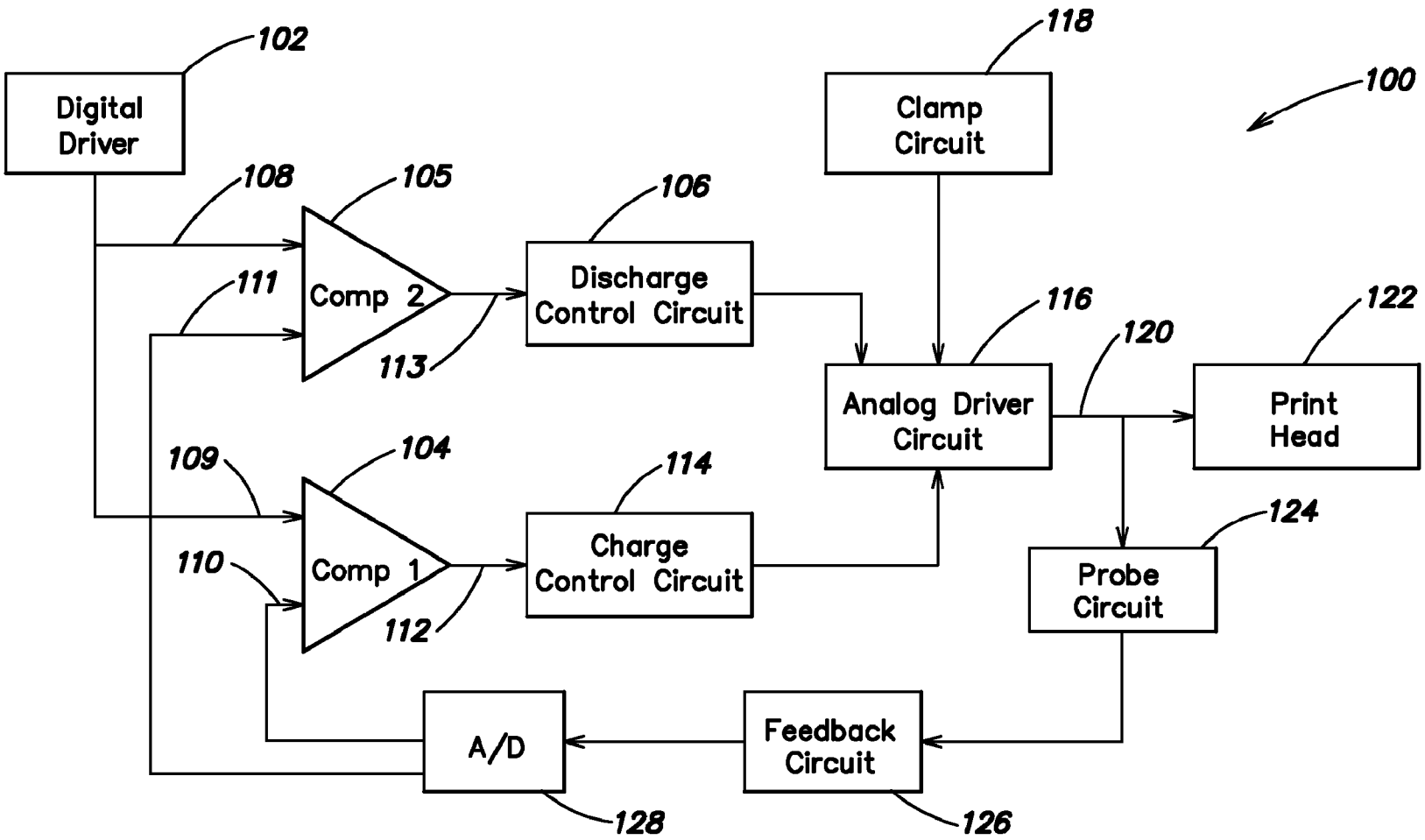
FIG. 2 is a schematic block diagram of an embodiment of a slew rate monitoring and control system provided in accordance with the present invention.

FIG. 2 is a schematic block diagram of an embodiment of a slew rate monitoring and control system 100 provided in accordance with the present invention. The system 100 includes a digital driver 102, which may comprise digital electronic components such as field-programmable gate arrays (FPGAs) adapted to generate digital signals for directing the operation of a print head. The digital driver 102 may include or be coupled to one or more processors and memory components (not shown) for carrying out its functions. The digital driver is electrically coupled to a first comparator 104 and a second comparator 105. The first comparator 104 includes first and second inputs 108, 110, the first of which 108 receives digital signals from the digital driver 102. The second comparator 105 includes first and second inputs 109, 111, the first of which 109 also receives digital signals from the digital driver 102. The comparators 104, 105 include digital and/or analog components known to those of skill in the art adapted to produce signals on respective output paths 112, 113 indicative of a difference in voltage between signals received at their respective first 108, 109 and second 110, 111 inputs. The output of the first comparator 104 is fed along output path 112 to a charge control circuit 114, and the output of the second comparator 105 is fed along output path 113 to a discharge control circuit 106.

Both the charge control circuit 114 and discharge control circuit 106 may include digital and/or analog components adapted to generate and transmit signals to an analog driver circuit 116 for controlling, respectively, the slew rates during charging and discharging of a PZT. For example, the charge control circuit 114 may transmit signals that cause the analog driver circuit 116 to begin a charging process or that cause changes in the charging slew rate. A clamp circuit 118 also outputs control signals to the analog driver circuit 116 for limiting a voltage during a portion of the charging and discharging cycle. Further details concerning the outputs of the discharge control circuit 106, the charge control circuit 114 and the clamp circuit 118 are described below in connection with the description of an embodiment of the analog driver circuit 116 illustrated in FIG. 3.

Referring again to FIG. 2, the analog driver circuit 116 receives inputs from the discharge control circuit 106, the charge control circuit 114 and the clamp circuit 118, and outputs an analog voltage signal along an electrical connection path 120 to a print head 122. The print head 122 may comprise, for example, an SE-128 print head supplied by Dimatix, Inc. of Lebanon, N.H., which includes 128 separate PZT channels, each channel controlling jetting through a single nozzle.

The analog voltage signal output from the analog driver circuit 116 is tapped by a probe circuit 124 which measures changes in the analog voltage $\Delta V$ at given time steps $\Delta t$. The probe circuit may be coupled to a feedback circuit 116 having components for dividing the level of the voltage signal by the time step for charging $\Delta t$, to determine an approximated measured slew rate ($\Delta V/\Delta t$). The feedback circuit 126 is in turn coupled to an analog/digital (A/D) converter 128 adapted to convert the output of the feedback circuit 126 into a digital signal. Depending on whether the PZT is in a charging phase or discharging phase, the digital signal output from the A/D converter 128 is supplied to either the second input 110 of the first comparator 104 (during the charging phase) or the second input of the second comparator 105 (during the discharging phase).

During a charging (ramp down) phase, the first comparator 104 receives a signal indicative of a nominal ramp down voltage from the digital driver 102 along first input 108; during a discharging (ramp up) phase, the second comparator 105 receives a signal indicative of a nominal ramp up voltage from the digital driver 102 along first input 109.

Through the feedback provided via the probe circuit 124, the comparators 104, 105 compare nominal ramp down or ramp up slew rates provided by the digital driver 102 with the corresponding measured ramp down or ramp up slew rates supplied via the analog driver circuit 116 and probe circuit 124. The level of the 'difference' signal output by the first comparator 104, indicative of the difference between the nominal ramp down and measured ramp down slew rates, is provided to the charge control circuit 114 which may generate control signals to the analog driver circuit 116 for adjusting the ramp down slew rate of the voltage output by the analog driver circuit 116 toward the nominal ramp down slew rate value by adjusting the charging current magnitude. Similarly, the level of the 'difference' signal output by the second comparator 105, indicative of the difference between the nominal ramp up and measured ramp up slew rates, is provided to the discharge control circuit 106 which may generate control signals to the analog driver circuit 116 for adjusting the ramp up slew rate of the voltage output by the analog driver circuit 116 toward the nominal ramp up slew rate value by adjusting the discharging current magnitude.

It is noted that while the various circuit components of system 100, such as the first and second comparators 104, 105, the discharge control circuit 106 and the charge control circuit 114 are described as discrete components, in actual implementations the components may be combined or integrated or alternatively, they may be split into smaller components having distinct functions. For example, the charge control circuit 114 may include separate circuits for controlling different outputs that it transmits to the analog driver circuit 116. It is intended that any and all of these implementations be deemed to be within the scope of the present invention.

Figure 3:
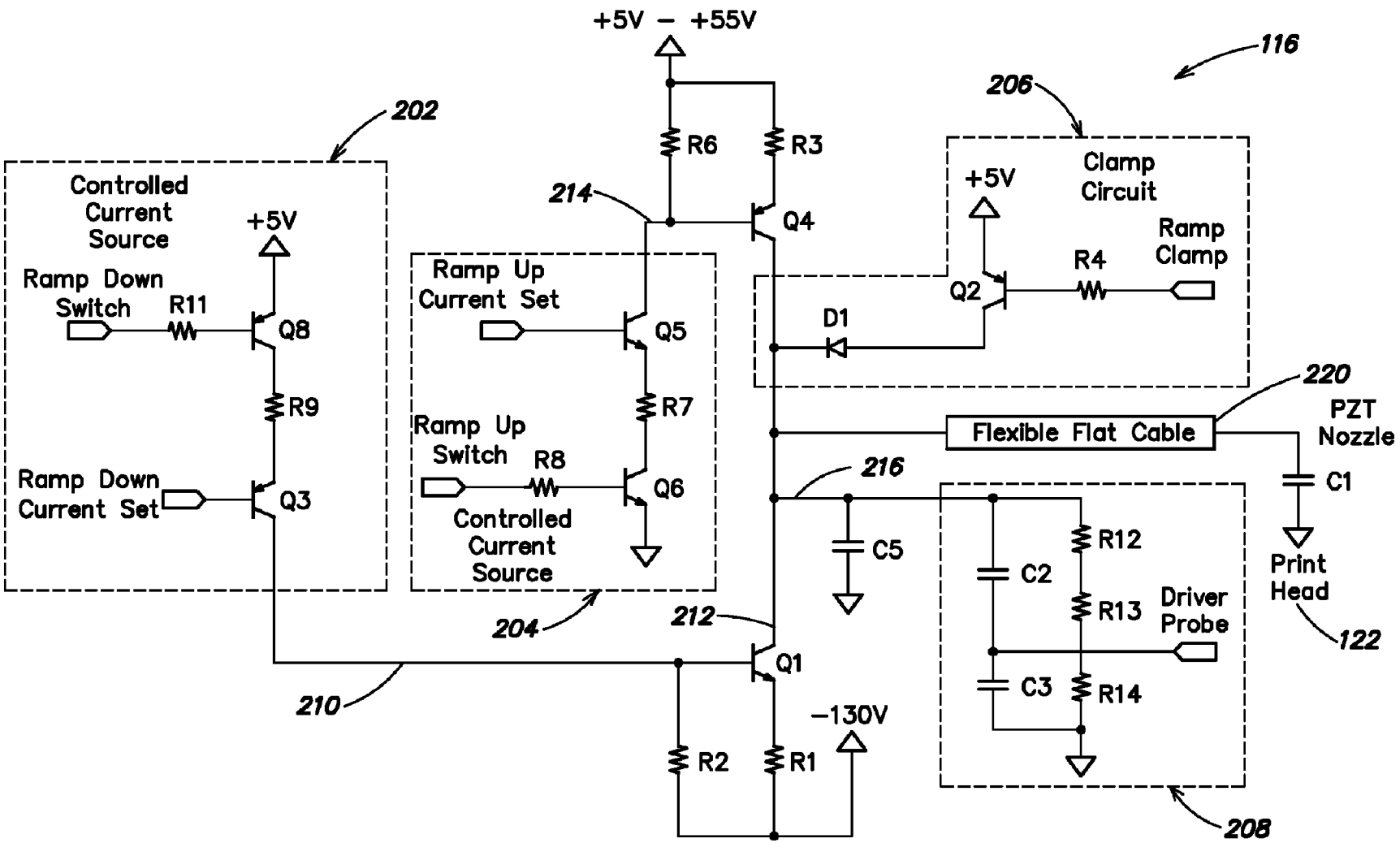
FIG. 3 is a schematic circuit diagram of an embodiment of an analog driver circuit provided in accordance with the present invention.

FIG. 3 is a circuit diagram of an embodiment of the analog driver circuit 116 provided according to the present invention. It is noted that the analog driver circuit 116 described below regulates a single PZT channel of the print head 122 and that similar circuits may be allocated for each of the plurality of PZT channels in the print head 122.

The exemplary analog driver circuit 116 depicted in FIG. 3 includes four separate functional portions: a controlled ramp down current source 202, a controlled ramp up current source 204, a clamping portion 206 and a probe portion 208.

The ramp down current source 202 receives control signals from the charge control circuit 114 (shown in FIG. 2) via two inputs, a ramp down switch input and a ramp down current set input. The ramp down switch input is coupled via a resistor R11 to a transistor Q8. The collector of transistor Q8 is coupled to a positive voltage supply. As shown, the magnitude of the positive voltage supply is set at 5 volts, but other voltage values may be used. The emitter of transistor Q8 is coupled to the collector of transistor Q3. The base of transistor Q3 receives signals from the charge control circuit 114 via the ramp down current set input.

The emitter of transistor Q3 is coupled to the base of another transistor Q1 along a connection path 210. The connection path 210 is coupled to a negative voltage supply via a resistor R2. As shown, the magnitude of the negative voltage supply is set at −130 volts, but other voltage values may be used. The emitter of transistor Q1 is also coupled to the negative voltage supply via resistor R1 arranged in parallel with resistor R2. The collector of transistor Q1 is coupled to connection path 212 which leads to the emitter of transistor Q4. The connection path 212 also branches at three locations between the collector of transistor Q1 and the emitter of transistor Q4. The branches lead to the clamping portion 206, the print head 122, and the probe portion 208, respectively, as described further below.

The collector of transistor Q4 is coupled to a positive voltage supply via a resistor R5. The magnitude of the positive voltage supply may be 5-55 volts, but other voltage values may be used. The base of transistor Q4 is coupled to the ramp up current source portion 204 via connection path 214. The ramp up current source portion also receives the positive voltage supply via resistor R6 along connection path 214.

The ramp up current source portion 204 includes a transistor Q5, the emitter of which is coupled to the base of transistor Q4 along connection path 214. The base of transistor Q5 receives input from the discharge control circuit 106 (shown in FIG. 2) via a ramp up current set input. The emitter of transistor Q5 is coupled via a resistor R7 to the collector of transistor Q6. The base of transistor Q6 also receives input from the discharge control circuit 106 via a ramp up switch via a resistor R8. The emitter of transistor Q6 is coupled to ground.

The clamping portion 206 of the analog driver circuit 116 includes a transistor Q2 supplied by a positive voltage of 5 volts at its collector (other voltage values may be used). The base of transistor Q2 receives input from the clamp circuit 118 (shown in FIG. 2) via a resistor R4. The emitter of transistor Q2 is fed to a diode D1 which permits current to flow from the emitter of transistor Q2 to connection path 212 but blocks current flow in the opposite direction.

The probe portion 208 includes a voltage compensator circuit having series capacitors and series resistors arranged in parallel. More specifically, the probe portion 208 includes resistors R12, R13 and R14 arranged in series, with the ends of the series resistors (the ends of R12 and R14 that are not coupled to R13) coupled respectively to connection path 212 via branch path 216 and ground. Similarly, a first end of capacitor C2 is coupled to the connection path 212 via branch path 216, a second end of capacitor C2 is coupled to a first end of capacitor C3, and the second end of capacitor C3 is coupled to ground, in parallel with series resistors R12, R13 and R14. The combination of capacitances and resistances help to generate an accurate reading of the voltage pulse and slew rate fed to the print head 122, which is measured at the probe output tapped between C2 and C3 and between R13 and R14. The probe output is fed to the probe circuit 124 (shown in FIG. 2). A further capacitor C5 having a low capacitance also taps the branch path 216 at its first end, with its second end coupled to ground, to reduce transient signal components fed to the voltage compensator circuit and probe output. An exemplary PZT channel of print head 122 represented by capacitor C1 receives an analog voltage/current signal from connection path 212 via cable 220.

Figure 6:
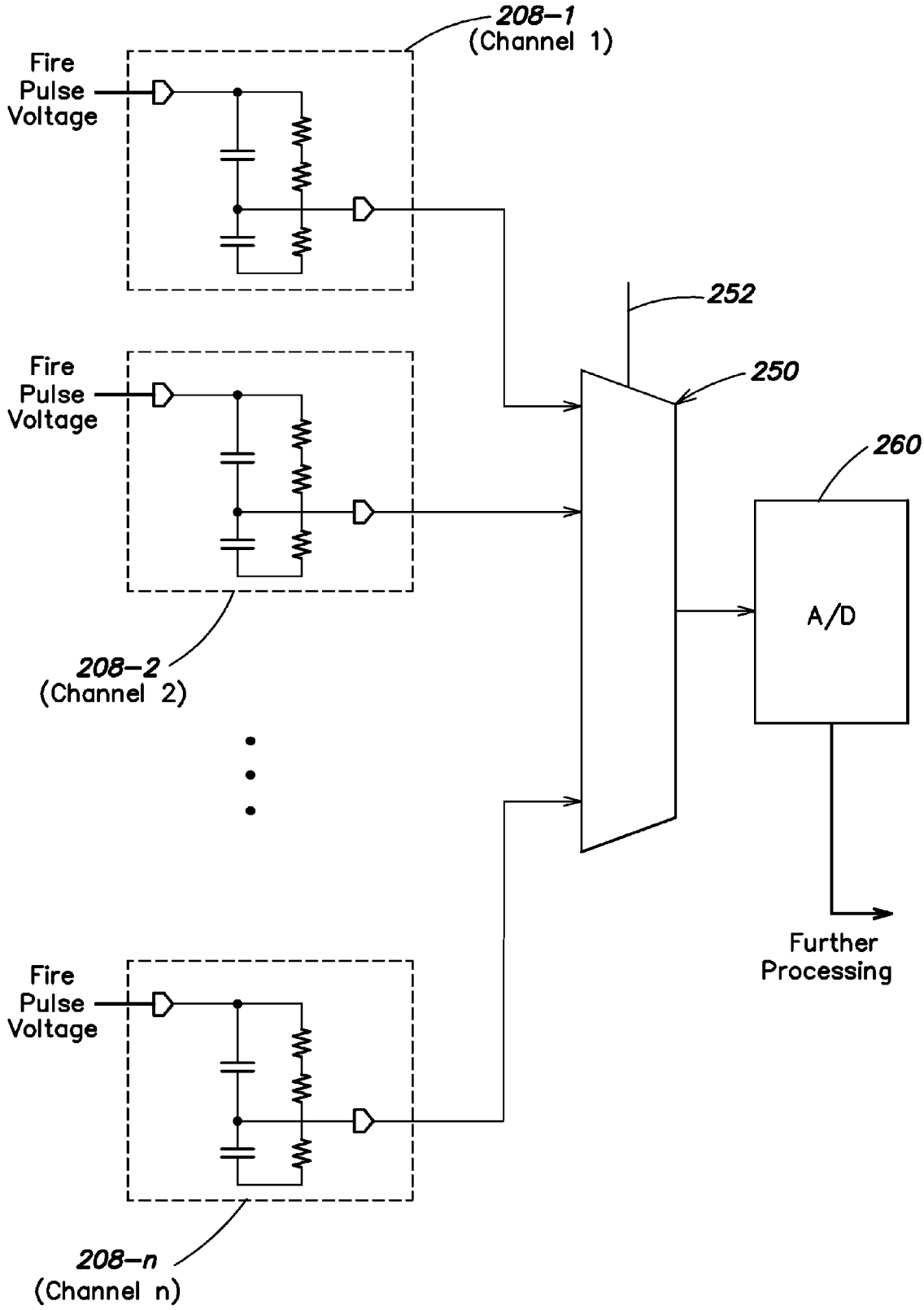
FIG. 6 is a schematic block diagram of an embodiment of a probe circuit provided in accordance with the present invention.

FIG. 6 is a schematic block diagram of an embodiment of a probe circuit that incorporates the probe portion (shown in FIG. 3) of each PZT channel, multiplexes the firing pulse voltage signals output from the PZT separate channels and converts the analog voltage signals to digital signals for further processing (e.g., diagnostic or testing processes).

As depicted, the probe portions 208-1 (designating the probe portion of the first channel), 208-2 (designating the probe portion of the second channel) up to **208-*n* (designating the probe portion of the nth or last channel) may be similar to the probe portion 208 shown in FIG. 3. In an exemplary embodiment, in which the SE-128 print head of Dimatix, Inc. is employed, which includes 128 separate PZT channels, the nth channel represents the $128^{th}$ channel of the print head. Each probe portion 208-1, 208-2 . . . 208-*n*** taps a firing pulse voltage signal supplied to the corresponding PZT capacitor channel of a print head without disturbing the corresponding firing pulse driver circuit that generates the firing pulse voltage signal.

All of the probe portions 208-1, 208-2 . . . **208-*n* deliver a firing pulse voltage signal to a multiplexer 250. The multiplexer 250, in turn, outputs, within a given time frame, the received input from one of the probe portions 208-1, 208-2 . . . 208-*n*, the particular channel output being selected via the multiplexer selection input 252. The output of the multiplexer 250 is fed to an analog/digital (A/D) converter 260 which converts the analog firing pulse voltage signal output from the multiplexer 250 into digital form at a particular sampling rate. The sampling rate of the A/D converter 260** may be set so as to take measurements of the firing pulse voltage signal at specified points in time along the fire pulse waveform. For example, the sampling rate may be set so as to take multiple measurements during the ramp up or ramp down phases of the firing pulse.

The digital output of the A/D converter 260 may be delivered to one or more processors (not shown) for further diagnostic processing. The diagnostic processing may include analyses to determine whether the firing pulse voltage meets certain specifications. Such analyses may include, for example, a determination as to whether the measured slew rate ($\Delta V/\Delta t$) is within preset upper and/or lower bounds indicative of a normally functioning PZT analog driver circuit. This information may be used, e.g., to determine whether the analog driver circuit is in operable condition.

Exemplary Operation of the Analog Driver Circuit

In operation, the analog driver circuit 116 can be controlled via the inputs described above to adjust the ramp down slew rates (the rate of charging of the PZT capacitor to a negative voltage) and the ramp up (the rate of discharging of the PZT capacitor from a negative voltage to zero or a positive voltage). The operation of the analog driver circuit 116 is also described with reference to a graph of an exemplary charge/discharge voltage cycle and the relative timing of activation pulses shown in FIG. 5.

Figure 5:
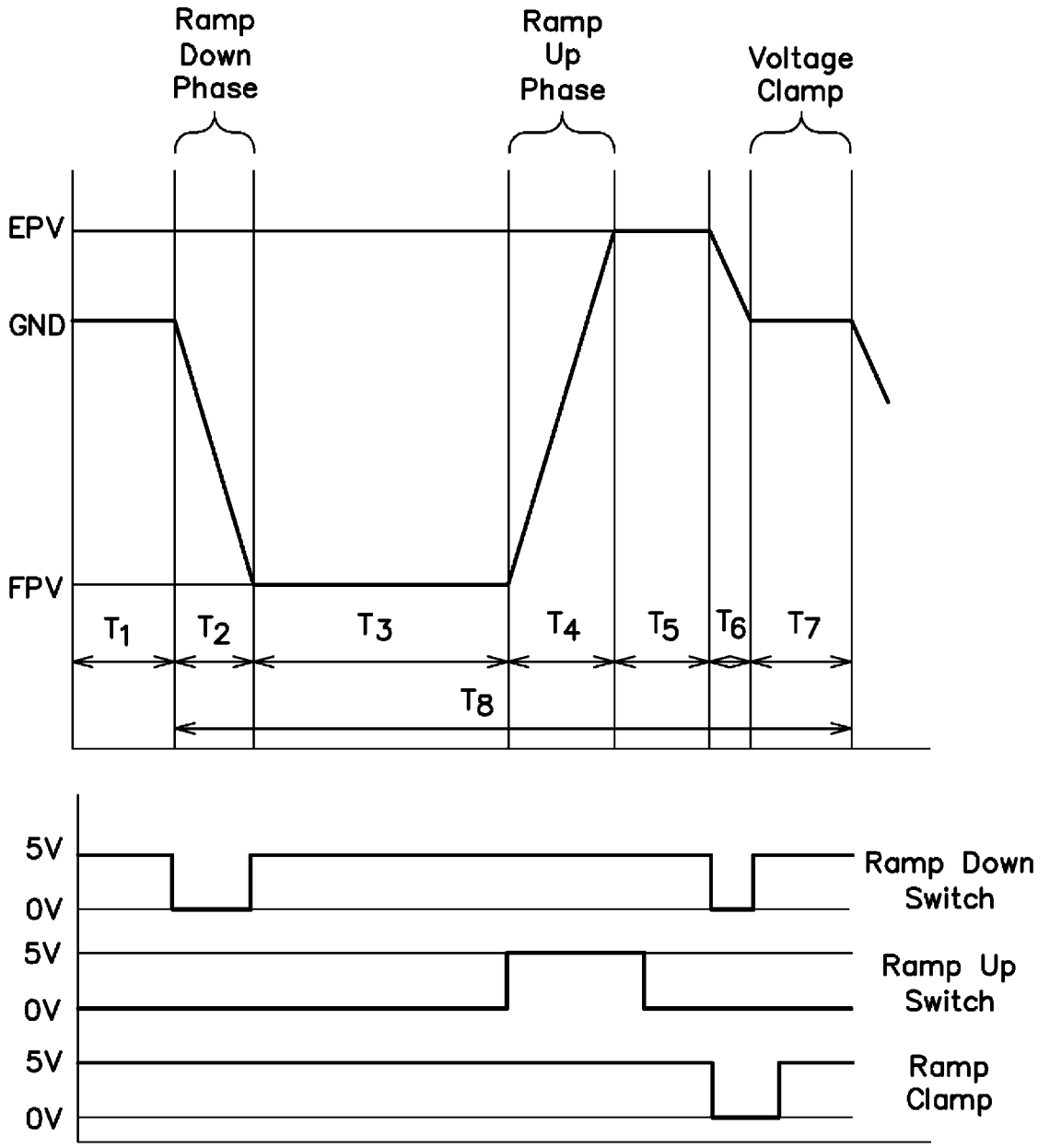
FIG. 5 is a graph of a charging and discharging cycle of the voltage at a PZT capacitor versus time according to an exemplary embodiment of the present invention. Timing of the activation of ramp up, ramp down and ramp clamp switches during the charging and discharging cycle is also shown.

The exemplary charge/discharge voltage cycle depicted in FIG. 5 (which may be employed in some embodiments of the present invention) begins with a waiting period $T_1$ at ground, followed by the charging phase in which PZT capacitor C1 linearly ramps down to a negative voltage (FPV) (e.g., −130 volts) during a ramp down time $T_2$. The charging phase may be activated by the edge-triggering of the ramp down switch by the charge control circuit 114 (shown in FIG. 2), which in the example shown switches from positive 5 volts to ground. The low voltage signal transmitted by the charge control circuit 114 via the ramp down switch is input to the base of transistor Q8, which acts as an on/off switch with respect to transistor Q3. That is, when transistor Q8 is switched to a conductive state via the ramp down switch input, it pulls the voltage level at the emitter of transistor Q3 down, forward biasing transistor Q3 into a conductive state, ultimately allowing current to flow to charge the PZT capacitor C1.

During the charging phase, when a difference arises between the nominal ramp down slew rate and the ramp down slew rate measured by the probe circuit 124 (shown in FIG. 2), the comparator 104 (shown in FIG. 2) delivers a difference signal to the charge control circuit 114. The charge control circuit 114 then transmits input(s) to the ramp down current source 202 to effectuate a change in the ramp down slew rate. Once transistor Q3 has been switched on via transistor Q8, an additional input provided by the charge control circuit 114 to the base of transistor Q3 via the ramp down current set input can be used to control the level of the collector current $I_c$ at Q3, since the collector current $I_c$ is typically related to the base current $I_b$ by an amplification factor (i.e., $I_c=\beta I_b$, where $\beta$ may be between 20 and 200, for example).

The collector current $I_c$ from Q3 is fed into the base of transistor Q1, i.e., the collector current $I_c$ of transistor Q3 becomes the base current $I_b$ of transistor Q1, providing for another round of current amplification. When both transistor Q8 and Q3 of the ramp down current source 202 are switched on, transistor Q1 is also forward biased into a conductive state, and the collector current $I_c$ at Q1 is directly related to the base current by a similar amplification factor. Thus, the ramp down current set inputs, through a series of intermediary effects, control the current $I_c$ at transistor Q1, with a large amplification factor.

Additionally, during the ramp down charging phase, transistor Q4 is not in a conductive state, so the collector current $I_c$ from transistor Q1 does not flow through transistor Q4. Similarly, diode D1 of the clamp portion 206 prevents the collector current $I_c$ from flowing into the clamp portion 206 during the charging phase. Therefore, the collector current $I_c$ from transistor Q1 is directed into the print head 122 via cable 220 and also into the probe portion 208 via branch path 216. Accordingly, during the ramp down charging phase, the collector current $I_c$ from Q1 controls the ramp down slew rate of the voltage signal provided at print head capacitor C1 per equation (1) above (i.e., the current I determines the slew rate dV/dt), and the probe circuit 124 is able to continually monitor the ramp down slew rate in time steps via the probe output. At the end of the ramp down charging phase, the charge control circuit 114 switches the ramp down switch from back to high (5 volts), and transistors Q8, Q3 and Q1 are switched into a non-conductive state.

Referring again to FIG. 5, once the PZT capacitor C1 has been fully charged to the fire pulse voltage (FPV) level, there is a waiting period $T_3$ during which the voltage remains stable at the FPV. At the end of $T_3$, the ramp up discharging phase begins. During the ramp up discharging phase, the PZTs release or 'jet' ink through the nozzles of the print head 122. As also shown in FIG. 5, at the beginning of period $T_4$, the discharge control circuit 106 (shown in FIG. 2) transmits a high voltage signal (5 volts) via the ramp up switch input to the base of transistor Q6 of the ramp up current source 204, which acts as an on/off switch with respect to transistor Q5. That is, when transistor Q6 is switched to a conductive state via the ramp down switch input, it pulls down the voltage level at the emitter of transistor Q5, forward biasing transistor Q5 into a conductive state. Once transistor Q5 is conductive, an additional input provided by the discharge control circuit 106 to the base of transistor Q5 via the ramp up current set input controls the level of the collector current $I_c$ at transistor Q5.

The collector current $I_c$ supplied from transistor Q5 is fed into the base of transistor Q4, i.e., the collector current $I_c$ of transistor Q5 becomes the base current $I_b$ of transistor Q4, providing for another round of current amplification. When both transistors Q6 and Q5 are conductive, transistor Q4 is forward biased into a conductive state, and the collector current $I_c$ supplied from Q4 is directly related to the base current $I_b$ by an amplification factor. Thus, the ramp up current set inputs, through a series of intermediary effects, control the collector current $I_c$ of transistor Q4.

During the ramp up charging phase (period $T_4$), transistor Q1 is not in a conductive state so that the capacitor C1 discharges via the collector current $I_c$ of transistor Q4 and does not discharge through Q1. Similarly, diode D1 of the clamp portion 206 prevents the discharge current from flowing into the clamp portion 206 during the discharging phase. Therefore, the discharge current from capacitor C1 is approximately equivalent to the collector current $I_c$ of transistor Q4. A portion of the discharge current is also sampled by the probe portion 208 via branch path 216. Accordingly, during the ramp up discharging phase the collector current $I_c$ at Q4 controls the ramp up slew rate of the voltage signal at print head capacitor C1 per equation (1), and the probe circuit 124 is able to continually monitor the ramp up slew rate in time steps via the probe output. At the end of period $T_4$, when the voltage has reached an upper limit (EPV), the discharge control circuit 106 switches the input signal at the ramp up switch 204 low (to ground), and transistors Q6, Q5 and Q4 are switched to a non-conductive state. The voltage at the PZT capacitor is then maintained at the high voltage (EPV) (e.g., 55 volts) for a period $T_5$.

At the end of period $T_5$ and the start of period $T_6$, the clamp portion 206 is activated in response to a low voltage input signal transmitted from clamping circuit 118 (shown in FIG. 2) to the ramp clamp input which switches transistor Q2 into a conductive state. In addition, the charge control circuit 114 also switches on transistors Q8, Q3 and Q1 via a low voltage signal to the ramp down switch input. By activating the ramp down switch, the voltage at the PZT capacitor begins to linearly ramp down, but the switching of transistor Q2 by the clamping circuit 118 places a lower limit (or 'clamp') on the ramp down, since the positive voltage supply level of 5 volts at the emitter of Q2 is passed on (minus a voltage drop across the diode D1) to the conductive path 212 and the PZT capacitor C1. By clamping the ramp down to the 5 volt rail, a consistent reference point for each charge/discharge cycle is maintained, which reduces instabilities at the PZT which can cause vibrations in the PZT crystal structure and possibly misfiring. The voltage is maintained at the 5 volt level for a period $T_7$, at the end of which a new cycle begins with a new low voltage (e.g., −130 volt) ramp down charging phase.

Figure 4A:
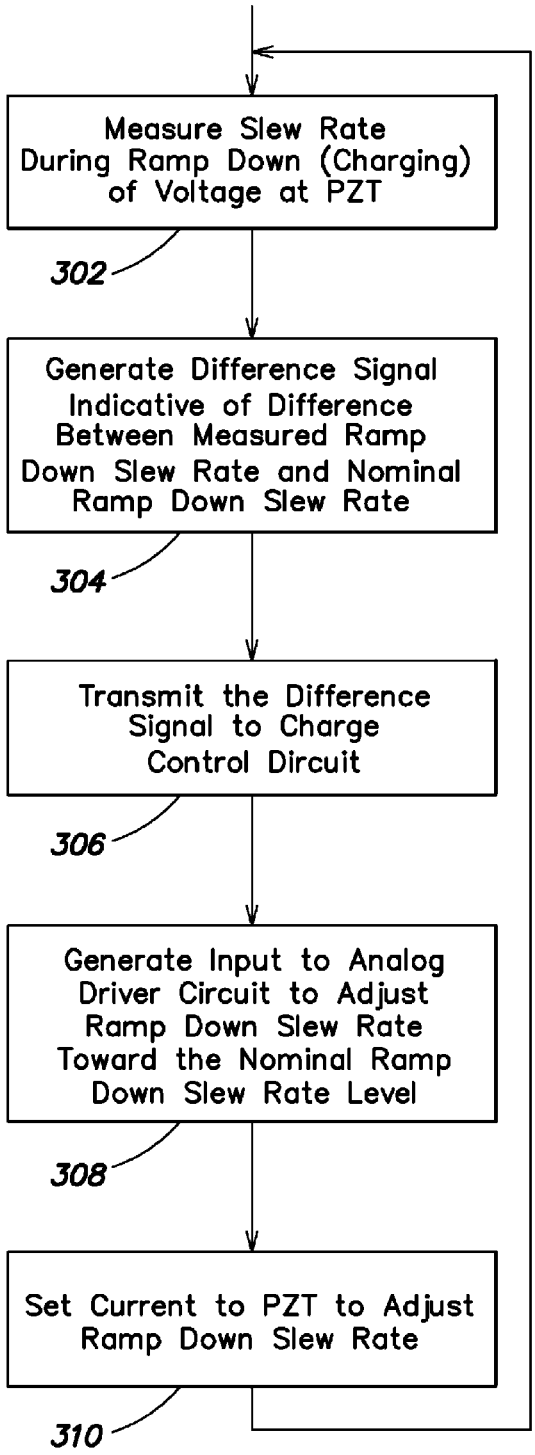
FIG. 4A is a flowchart of an exemplary embodiment of a PZT charging process in which the slew rate is controlled via feedback.

Exemplary Methods of Controlling the Ramp Down and Ramp Up Slew Rates During Jetting FIG. 4A is a flow chart of an exemplary method for controlling jetting stability via control of the voltage signal slew rate during the ramp down (charging) phase using the system described above according to the present invention.

In step 302, the slew rate during the ramp down charging phase is measured. In step 304, a difference signal indicative of a difference between the measured ramp down slew rate and a nominal value of the ramp down slew rate is generated. In step 306, the difference signal is transmitted to the charge control circuit 114, which then generates input(s) to the analog driver circuit 116 to adjust the ramp down slew rate toward the nominal ramp down slew rate in step 308. In step 310, the current delivered to the PZT capacitor is set (via the analog driver circuit 116) to adjust the ramp down slew rate in accordance with the input signals received from the charge control circuit 114. After step 310, the method cycles back to step 302 for a further measurement of the actual ramp down slew rate, providing a continual closed-loop feedback process.

Figure 4B:
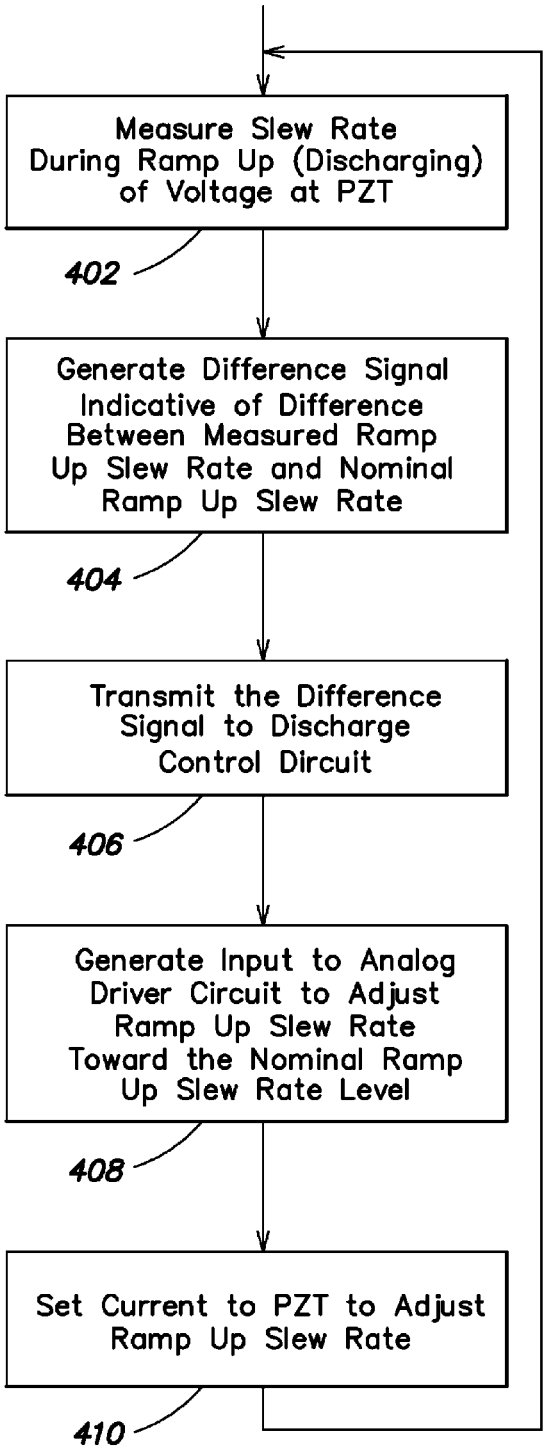
FIG. 4B is a flowchart of an exemplary embodiment of a PZT discharging process in which the slew rate is controlled via feedback.

FIG. 4B is a flow chart of an exemplary method for controlling jetting stability via control of the voltage signal slew rate during the ramp up (discharging) phase using the system described above according to the present invention.

In step 402, the slew rate during the ramp up discharging phase is measured. In step 404, a difference signal indicative of a difference between the measured ramp up slew rate and a nominal value of the ramp up slew rate is generated. In step 406, the difference signal is transmitted to the discharge control circuit 106, which then generates input(s) to the analog driver circuit 116 to adjust the ramp up slew rate toward the nominal ramp up slew rate in step 408. In step 410, the current delivered to the PZT capacitor is set (via the analog driver circuit 116) to adjust the ramp up slew rate in accordance with the input signals received from the discharge control circuit 106. After step 410, the method cycles back to step 402 for a further measurement of the actual ramp up slew rate, providing a continual closed-loop feedback process.

The foregoing description discloses only particular embodiments of the invention; modifications of the above disclosed methods and apparatus which fall within the scope of the invention will be readily apparent to those of ordinary skill in the art. For example, the present invention may also be applied to spacer formation, polarizer coating, and nanoparticle circuit forming. Accordingly, while the present invention has been disclosed in connection with specific embodiments thereof, it should be understood that other embodiments may fall within the spirit and scope of the invention, as defined by the following claims.

The invention claimed is:

1. A system for monitoring characteristics of a voltage signal provided to a PZT capacitor of a print head comprising:

a digital driver circuit adapted to generate and transmit a signal indicating a nominal slew rate;

a probe circuit coupled to the capacitor for measuring a firing pulse voltage signal provided to the capacitor;

a comparator coupled to the digital driver and the probe circuit adapted to compare a measured slew rate as determined from the measured firing pulse voltage signal with the nominal slew rate and to generate a difference signal indicating a difference in magnitude between the measured slew rate and the nominal slew rate;

an analog driver circuit coupled to the comparator adapted to adjust the slew rate of the voltage signal provided to the capacitor in response to the difference signal received from the comparator; and an analog/digital converter coupled to the probe circuit adapted to sample the firing pulse voltage signal output from the probe circuit and to provide a digital output signal for diagnostic purposes.

2. The system of claim 1 wherein the digital driver circuit includes a processor.

3. The system of claim 1 wherein the probe circuit includes voltage compensator circuit.

4. The system of claim 1 wherein the comparator includes a first and a second comparator.

5. The system of claim 1 wherein the analog driver circuit includes a controlled ramp down current source, a controlled ramp up current source, and a clamping portion.

6. The system of claim 1 wherein the analog/digital converter is adapted to convert output of a feedback circuit into a digital signal.

7. A system for monitoring and controlling a slew rate of a voltage signal provided to a PZT capacitor of a print head comprising:

a digital driver circuit adapted to generate and transmit a signal indicating a nominal slew rate;

a probe circuit coupled to the capacitor for measuring an actual slew rate of the voltage signal provided to the capacitor;

a comparator coupled to the digital driver and the probe circuit adapted to compare the measured slew rate with the nominal slew rate and to generate a difference signal indicating a difference in magnitude between the measured slew rate and the nominal slew rate; and an analog driver circuit coupled to the comparator adapted to adjust the slew rate of the voltage signal provided to the capacitor in response to the difference signal received from the comparator.

8. The system of claim 7 wherein the digital driver circuit includes a processor.

9. The system of claim 7 wherein the probe circuit includes voltage compensator circuit.

10. The system of claim 7 wherein the comparator includes a first and a second comparator.

11. The system of claim 7 wherein the analog driver circuit includes a controlled ramp down current source, a controlled ramp up current source, and a clamping portion.

12. The system of claim 7 further including an analog/digital converter adapted to convert output of a feedback circuit into a digital signal.

13. The system of claim 12 wherein the analog/digital converter is coupled to the probe circuit and adapted to sample the firing pulse voltage signal output from the probe circuit and to provide a digital output signal for diagnostic purposes.

14. A method for monitoring characteristics of a voltage signal provided to a PZT capacitor of a print head comprising:

generating and transmitting a signal indicating a nominal slew rate;

measuring a firing pulse voltage signal provided to the PZT capacitor;

comparing a measured slew rate as determined from the measured firing pulse voltage signal with the nominal slew rate;

generating a difference signal indicating a difference in magnitude between the measured slew rate and the nominal slew rate;

adjusting the slew rate of the voltage signal provided to the PZT capacitor in response to the difference signal;

sampling the firing pulse voltage signal; and providing a digital output signal for diagnostic purposes based on the sampling.

15. The method of claim 14 wherein generating and transmitting a signal indicating a nominal slew rate is performed using a digital driver circuit.

16. The method of claim 15 wherein measuring a firing pulse voltage signal provided to the PZT capacitor is performed using a probe circuit coupled to the PZT capacitor.

17. The method of claim 16 wherein comparing a measured slew rate as determined from the measured firing pulse voltage signal with the nominal slew rate is performed using a comparator coupled to the digital driver and the probe circuit.

18. The method of claim 17 wherein generating a difference signal indicating a difference in magnitude between the measured slew rate and the nominal slew rate is performed using the comparator.

19. The method of claim 18 wherein adjusting the slew rate of the voltage signal provided to the capacitor in response to the difference signal received from the comparator is performed using an analog driver circuit coupled to the comparator.

20. The method of claim 19 wherein sampling the firing pulse voltage signal output from the probe circuit is performed using an analog/digital converter coupled to the probe circuit.

21. The method of claim 20 wherein providing a digital output signal for diagnostic purposes is performed using the analog/digital converter coupled to the probe circuit.

* * * * *